US007469677B2

(12) United States Patent
Hannewald et al.

(10) Patent No.: US 7,469,677 B2
(45) Date of Patent: Dec. 30, 2008

(54) THROTTLE VALVE DEVICE

(75) Inventors: Thomas Hannewald, Griesheim (DE); Stefan Köhler, Frankfurt (DE); Hubert Limbrunner, Kirchroth (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/597,843

(22) PCT Filed: Jan. 20, 2005

(86) PCT No.: PCT/EP2005/050241

§ 371 (c)(1),
(2), (4) Date: May 3, 2007

(87) PCT Pub. No.: WO2005/078260

PCT Pub. Date: Aug. 25, 2005

(65) Prior Publication Data

US 2008/0006241 A1 Jan. 10, 2008

(30) Foreign Application Priority Data

Feb. 10, 2004 (DE) ..... 10 2004 006 555

(51) Int. Cl.
*F02D 9/10* (2006.01)

(52) U.S. Cl. ..... 123/403; 123/337; 251/308

(58) Field of Classification Search ..... 123/336, 123/337, 361, 399, 403; 251/305, 306, 359, 251/307, 308; 264/242, 250, 259, 255, 328.8; 73/118.2

See application file for complete search history.

(56) References Cited

U.S. PATENT DOCUMENTS 3,394,914 A 7/1968 Nagasato ..... 251/173

(Continued)

FOREIGN PATENT DOCUMENTS

| | | | |
|---|---|---|---|
| DE | 19854594 | A1 | 5/2000 |
| DE | 101 14 994 | A1 | 10/2001 |
| DE | 101 37 771 | A1 | 2/2003 |
| DE | 101 40 394 | A1 | 3/2003 |
| EP | 1186763 | A2 | 3/2002 |
| EP | 1281847 | A2 | 2/2003 |
| EP | 1308612 | A1 | 5/2003 |

OTHER PUBLICATIONS

International Search Report and Written Opinion for International Application No. PCT/EP2005/050241 (15 pages).

*Primary Examiner*—Willis R. Wolfe, Jr.
*Assistant Examiner*—Johnny H. Hoang
(74) *Attorney, Agent, or Firm*—Baker Botts L.L.P.

(57) ABSTRACT

A butterfly valve device (1), particularly an electrically actuated butterfly valve device (1) e.g. for use in an intake manifold of an internal combustion engine is designed in such a way that the effort required for assembling the intake manifold can be reduced while the requirements regarding dimensional tolerances and tightness can be met and the number of parts is minimized. This aim is achieved by the fact that at least one housing part (3) of the butterfly valve device (1) is embodied monolithically along with an intake pipe (15) that is disposed upstream or downstream of the butterfly valve device (1).

14 Claims, 3 Drawing Sheets

U.S. PATENT DOCUMENTS 5,979,871 A * 11/1999 Forbes et al. ..... 251/305
5,988,131 A * 11/1999 Hernandez et al. ..... 123/184.21
6,354,267 B1 3/2002 Kotchi et al. ..... 123/337
6,491,020 B2 12/2002 Kotchi et al. ..... 123/337
6,505,643 B2 1/2003 Scholten et al. ..... 137/554
6,986,860 B2 1/2006 Schaefer et al. ..... 24/242
7,143,996 B2 12/2006 Kohlen et al. ..... 251/305

* cited by examiner

THROTTLE VALVE DEVICE

CROSS-REFERENCE TO RELATED APPLICATIONS

This application is a U.S. national stage application of International Application No. PCT/EP2005/050241 filed Jan. 20, 2005, which designates the United States of America, and claims priority to German application number DE 10 2004 006 555.1 filed Feb. 10, 2004, the contents of which are hereby incorporated by reference in their entirety.

TECHNICAL FIELD

The invention relates to a throttle valve device.

BACKGROUND

Known throttle valve devices, particularly electrically operable throttle valve devices for internal combustion engines, have a throttle valve housing in which a throttle valve for varying a flow cross section for a gas is pivotally mounted. In some cases the throttle valve is implemented in an electrically drivable manner. For tolerance reasons, the throttle valve housings of known throttle valve devices are generally made of metal or a thermosetting plastic. The throttle valve housing is sealed by a cover which serves on the one hand to cover a drive casing and, on the other, constitutes a counter bearing for a throttle valve shaft in the region of a passage cross section of the throttle valve device. Both the throttle valve housing and the throttle valve cover have fixing means whereby the throttle valve device can be mounted on an upstream air filter device and on a downstream intake pipe device. The disadvantage of known throttle valve devices of this kind is that the time and effort of mounting the throttle valve device in the intake tract of an internal combustion engine is costly. Moreover, increased sealing complexity is required.

SUMMARY

The object of the invention is to create a throttle valve device which significantly reduces the assembly cost of an intake tract of an internal combustion engine while at the same time meeting the requirements placed on a throttle valve device in respect of long service life, moisture resistance and dimensional stability. In addition, the throttle valve device is to be easily manufacturable using few components and in an inexpensive manner.

This object can be achieved with by a throttle valve device according to the invention having at least two housing parts and a throttle valve, one of said housing parts having a throttle pipe section which cooperates with the throttle valve, the other housing part forming a monolithic part with at least one upstream or downstream duct section.

One of the housing parts can be a throttle valve housing and the other housing part can be a throttle valve housing cover. The duct section can be an intake pipe section or an intake pipe. One of the housing parts can be made of metal and/or a thermosetting plastic. One of the housing parts can be made of a thermoplastic injection moldable plastic. One of the housing parts can be made of PA 6, PA 6.6, PA 4.6 or a thermoplastic mixed plastic. The throttle valve housing may incorporate the throttle pipe section and a drive casing section which are interconnected as one piece. The throttle valve housing cover may have a drive casing cover section and a pipe flange which are interconnected as one piece. The throttle valve housing cover and the throttle valve housing can be assembled together with separation planes at an angle to one another. The throttle valve may be rotatably and/or pivotally mounted via a bearing recess in the throttle valve housing cover and in the throttle valve housing as well as opposite the bearing recess in a recess inside the throttle pipe section.

According to the invention it was recognized that only the throttle valve housing in which the actual throttle valve is mounted and in which stop edges for the throttle valve are formed needs to be made of metal and/or a thermosetting plastic. According to the invention, the cover of the inventive throttle valve device is made from an essentially less expensive thermoplastic material. In addition, at least one intake pipe section is of a piece with the cover of the throttle valve device. This allows at least a shift of the mounting plane between the throttle valve device and a downstream intake pipe, ideally even the elimination of such a mounting plane, i.e. if the intake pipe is of a piece with the throttle valve cover.

This has the considerable advantage of enabling the location of the mounting plane between the throttle valve device and downstream and/or upstream intake pipe elements to be more freely selected, thereby achieving greater degrees of freedom in the constructional design. In the ideal case a mounting plane can be dispensed with completely.

BRIEF DESCRIPTION OF THE DRAWINGS

The invention will now be explained in greater detail using examples and with reference to the accompanying drawings in which.

DETAILED DESCRIPTION

Figure 1:
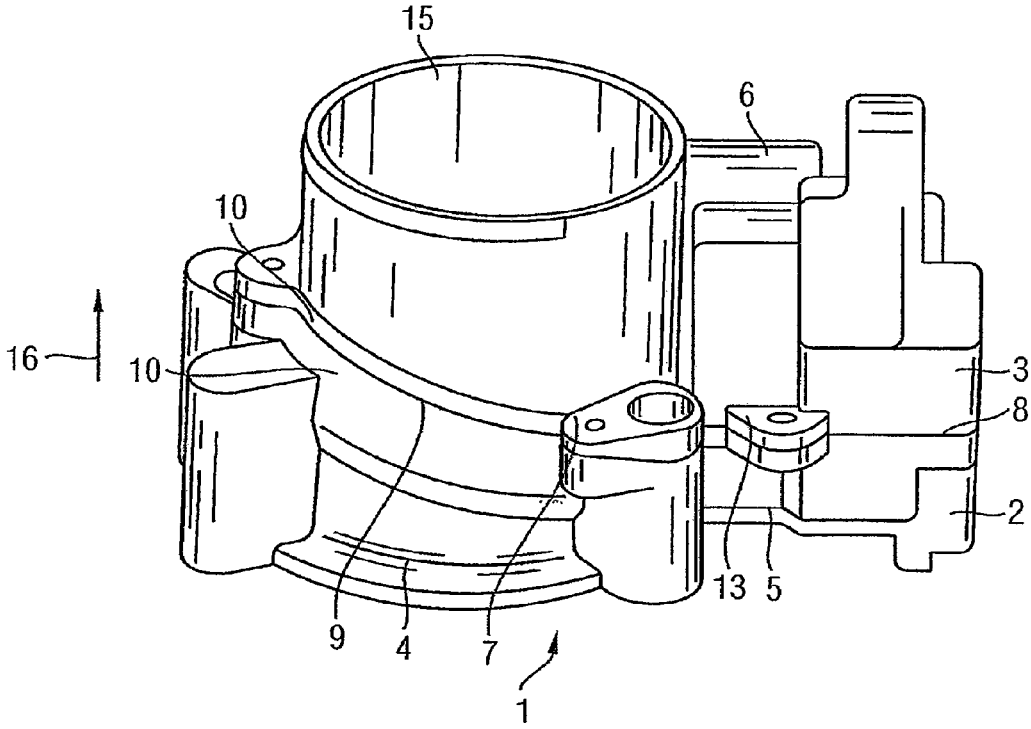
FIG. 1: shows a perspective view of throttle valve device according to the invention.
Figure 2:
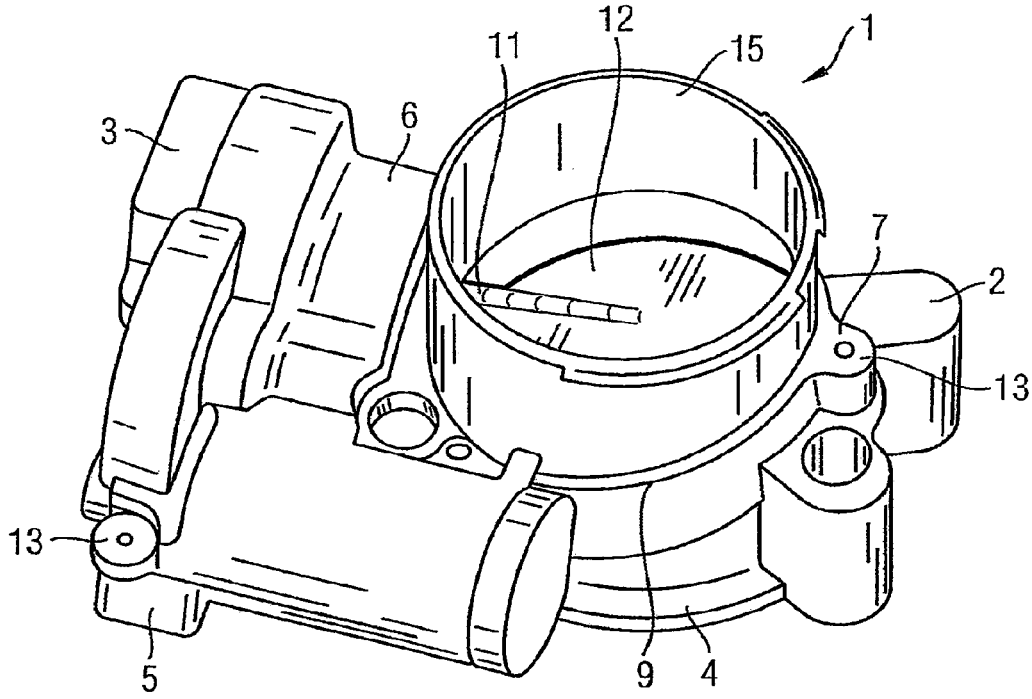
FIG. 2: shows a further view of a throttle valve device according to the invention from a different perspective from FIG. 1 so as to make the interior of the intake pipe section visible.
Figure 3:
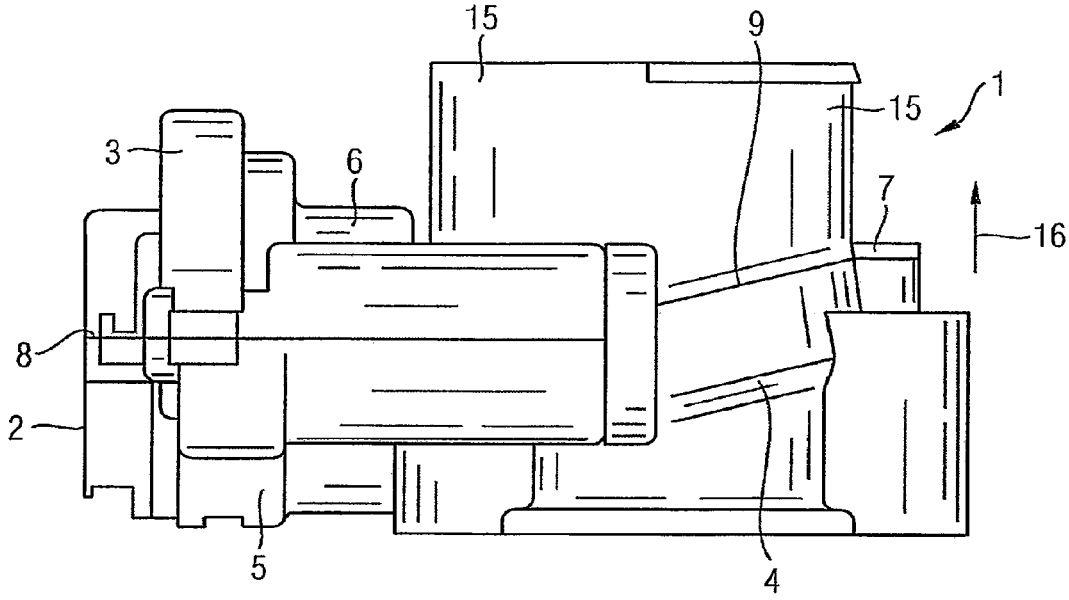
FIG. 3: shows a side elevation of the throttle valve device according to the invention as shown in FIGS. 1 and 2.

An inventive throttle valve device 1 (FIGS. 1 to 3) has a throttle valve housing 2 and a throttle valve housing cover 3.

The throttle valve housing 2 has throttle pipe section 4 and a drive casing section 5. The throttle valve housing cover 3 has a drive casing cover section 6 which is connected to a pipe flange 7.

The drive casing section 5 and the drive casing cover section 6 form a parting line 8 which divides approximately symmetrically the drive casing comprising the drive casing section 5 and the drive casing cover section 6.

The throttle pipe section 4 of the throttle valve housing 2 and the pipe flange 7 of the throttle valve housing cover 3 form a second parting line 9. The second parting line 9 is disposed at an angle to the first parting line 8 so that the sealing surfaces forming the parting lines 8, 9 of the throttle valve housing 2 and of the throttle valve housing cover 3 meet in the region between the drive casing 5, 6 and a throttle pipe 10 consisting of the throttle pipe section 4 and the pipe flange 7, forming a kink.

At the transition from the drive casing 5, 6 to the throttle pipe 10, the position of the parting line is selected such that a throttle valve shaft 11 of a throttle valve 12 is pivotally mounted via a bearing recess in the throttle valve housing cover 3 and in the throttle valve housing 2. At an opposite end of the throttle valve shaft 11 the latter is mounted only in a suitable recess inside the throttle pipe section 4 in such a way that the pipe flange 7 is not involved in supporting the throttle valve shaft 11 there. This means that it is possible to preassemble the entire drive (not shown) and the throttle valve 12 together with the throttle valve shaft 11 only in the throttle valve housing 2, so that by placing on and fixing the throttle valve housing cover 3 by means of fixing elements such as mounting clips, mounting surfaces 13 and/or bolts (not shown), fixing can be performed on the throttle valve housing 2 and therefore the drive casing is sealed and the throttle valve 11 is pivotally mounted in the throttle pipe 10.

It is particularly advantageous here that all the relevant dimensional tolerances for installing the drive and in particular for installing the throttle valve 12 or more precisely for supporting the throttle valve, and the surfaces of the throttle pipe section 4 cooperating with throttle valve edges, are all provided in a single housing part, i.e. specifically in the throttle valve housing 2. The throttle valve cover 3 thus only has a covering function and need not therefore meet such stringent requirements in terms of dimensional accuracy, dimensional tolerances and dimensional stability, particularly due to moisture ingress, as the throttle valve housing 2.

For the throttle valve housing 2 in which the throttle gaps between the throttle valve 12 and the throttle pipe section 4 exist, this is of great importance, as even small variations in gap dimensions or more precisely the creation of gaps of smaller cross section can have a significant effect on the supply or more precisely the mixture formation for an internal combustion engine.

Therefore the throttle valve housing 2 is preferably made of metal or a thermosetting plastic, as these materials are capable of maintaining the required tolerances even over lengthy periods of time, particularly when subjected to moisture or strongly fluctuating temperature effects. According to the invention it was now recognized that it is possible, by reducing the function of the throttle valve housing cover 3 to merely a covering function, to make it from a less expensive material, particularly from a plastic which can be processed in an injection molding process.

For this purpose thermoplastic materials in particular, such as PA 6, PA 6.6, PA 4.6 or thermoplastic mixed plastics, have proved suitable according to the invention. As due to material selection the throttle valve housing cover 3 can be manufactured using conventional injection molding methods, there is disposed in the region of the pipe flange 7 at least one subregion of an intake pipe, i.e. at least one intake pipe section 15 which is disposed in a flow direction 16 e.g. upstream of the throttle pipe section 4 is of a piece with the throttle valve housing cover 3. Preferably the intake pipe usually disposed between the throttle valve device 1 and the engine or rather its intake manifold is connected as a whole, as a single piece, to the throttle valve housing cover 3.

This measure means that there is one less joining plane between an intake pipe and the throttle valve device 1. If an intake valve section 15 is formed on the throttle valve housing cover 3, this allows a freer selection of the mounting plane to the component following the intake pipe section 15 depending on the length of the intake pipe section 15 and the shape of the intake port section 15 in respect of its tubular characteristics. The intake pipe section 15 or rather the intake pipe is essentially cylindrically tubular and is characterized in that it has no interaction surfaces with the throttle valve 12 or rather its boundary edges.

In the throttle valve device according to the invention it is particularly advantageous that a target conflict has been resolved such that a cost reduction could be achieved by reducing the number of components while at the same time providing greater constructional design freedom. It is further advantageous that the leak-proneness and therefore the reliability of the entire throttle valve device 1 in interaction with downstream components is considerably improved, because a sealing plane or rather a parting plane with associated fixing devices can be dispensed with.

What is claimed is:

1. A throttle valve device comprising at least two housing parts and a throttle valve, one of the housing parts having a throttle pipe section which cooperates with the throttle valve, the other housing part is designed in one piece with at least one duct section disposed upstream or downstream of the throttle valve device, wherein the one housing part being a throttle valve housing and the other housing part being throttle valve housing cover, wherein the throttle valve housing cover and the throttle valve housing exhibit an inclined separation plane in the region of the throttle pipe section such that a throttle valve shaft is mounted in a rotatable and/or pivotable manner on one end between the throttle valve housing and the throttle valve housing cover and only in the throttle pipe section on an opposing end.

2. A throttle valve device according to claim 1, wherein the duct section is an intake pipe section or an intake pipe.

3. A throttle valve device according to claim 1, wherein one of the housing parts is made of metal and/or a thermosetting plastic.

4. A throttle valve device according to claim 1, wherein one of the housing parts is made of a thermoplastic injection moldable plastic.

5. A throttle valve device according to claim 1, wherein one of the housing parts is made of PA 6, PA 6.6, PA 4.6 or a thermoplastic mixed plastic.

6. A throttle valve device according to claim 1, wherein the throttle valve housing incorporates the throttle pipe section and a drive casing section which are interconnected as one piece.

7. A throttle valve device according to claim 1, wherein the throttle valve housing cover has a drive casing cover section and a pipe flange which are interconnected as one piece.

8. A throttle valve device comprising a throttle valve, a first housing part having a throttle tube segment which cooperates with the throttle valve, and a second housing part is designed as a single piece with at least one channel segment disposed upstream or downstream of the throttle valve device, wherein the first housing part being a throttle valve housing and the second housing part being throttle valve housing cover, wherein the throttle valve housing cover and the throttle valve housing exhibit an inclined separation plane in the region of the throttle tube segment such that a throttle valve shaft is mounted in a rotatable and/or pivotable manner on one end between the throttle valve housing and the throttle valve housing cover and only in the throttle tube segment on an opposing end.

9. A throttle valve device according to claim 8, wherein the channel segment is an intake pipe section or an intake pipe.

10. A throttle valve device according to claim 8, wherein the first housing part is made of metal and/or a thermosetting plastic.

11. A throttle valve device according to claim 8, wherein the second housing part is made of a thermoplastic injection moldable plastic.

12. A throttle valve device according to claim 8, wherein the second housing part is made of PA 6, PA 6.6, PA 4.6 or a thermoplastic mixed plastic.

13. A throttle valve device according to claim 8, wherein the throttle valve housing incorporates the throttle pipe section and a drive casing section which are interconnected as one piece.

14. A throttle valve device according to claim 8, wherein the throttle valve housing cover has a drive casing cover section and a pipe flange which are interconnected as one piece.

* * * * *